United States Patent [19]

Tsutsui

[11] 4,249,053

[45] Feb. 3, 1981

[54] PUSH BUTTON SWITCH

[75] Inventor: Kotaroh Tsutsui, Yokohama, Japan

[73] Assignee: Alps Electric Co., Ltd., Tokyo, Japan

[21] Appl. No.: 81,856

[22] Filed: Oct. 4, 1979

[30] Foreign Application Priority Data

Oct. 5, 1978 [JP] Japan ..... 53-137164

[51] Int. Cl.[3] ..... H01H 3/14

[52] U.S. Cl. ..... 200/153 J; 200/159 R

[58] Field of Search ..... 200/153 L, 153 LA, 153 J, 200/159, 328, 325

[56] References Cited

U.S. PATENT DOCUMENTS

| | | | |
|---|---|---|---|
| 3,187,602 | 6/1965 | Cousins | 200/153 J |
| 3,582,592 | 6/1971 | Schadow | 200/159 R |
| 3,882,295 | 5/1975 | Madland | 200/159 R |
| 4,112,277 | 9/1978 | Kleeb | 200/153 J |

FOREIGN PATENT DOCUMENTS

| | | | |
|---|---|---|---|
| 1324091 | 7/1973 | United Kingdom | 200/153 J |
| 1336016 | 11/1973 | United Kingdom | 200/153 J |

*Primary Examiner*—John W. Shepperd

*Attorney, Agent, or Firm*—Guy W. Shoup; Gerard F. Dunne

[57] ABSTRACT

A push-button switch of the non-locking type includes a tactile feedback mechanism, the mechanism being so constructed that a cam follower supported in a cantilever fashion is held in sliding contact with a cam provided in a slider carrying movable contacts, whereby when a plunger of the slider is depressed or released, the cam and the cam follower cooperate to give the operator a tactile feedback of operation of the switch.

5 Claims, 8 Drawing Figures

PUSH BUTTON SWITCH

The present invention relates to a push-button switch.

In recent years, push-button switches have been used in large numbers in such items as keyboards and electronic tuners' and they have been increasingly miniaturized. Most of these switches are of the so-called non-locking type, and they typically are not equipped with any tactile feedback mechanism to indicate proper operation. Accordingly, when the switches are operated, operators cannot be sure that the switch has operated properly.

It is therefore an object of the present invention to provide a push-button switch which is equipped with a tactile feedback mechanism.

Another object of the present invention is to provide a non-locking type push-button switch which is equipped with a tactile feedback mechanism.

Still another object of the present invention is to provide a tactile feedback mechanism which is suitable for a miniturized switch.

DESCRIPTION OF THE DRAWINGS

FIG. 3*a* is a partially enlarged plan view showing the cam groove portion of a slider in the switch of the embodiment, while

Figure 1:
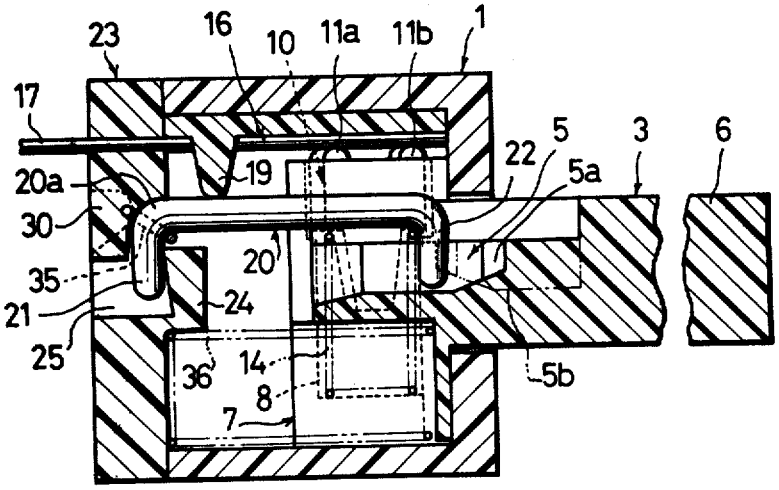
FIG. 1 is a cross-sectional side view through a mid portion of a switch embodying the present invention.

An embodiment of the present invention will be described with reference to FIGS. 1 through 7. Numeral 1 designates a housing which forms the outer casing of a switch and which is made of a synthetic resin. The front of the housing 1 is provided with a guide hole 2 for receiving the plunger 6 of a slider 3.

Figure 3A:
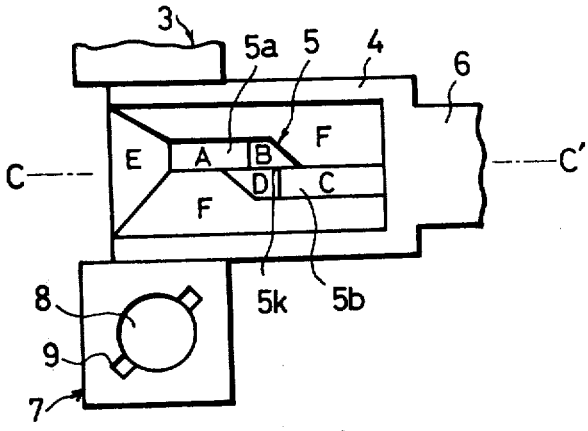
Figure 3B:
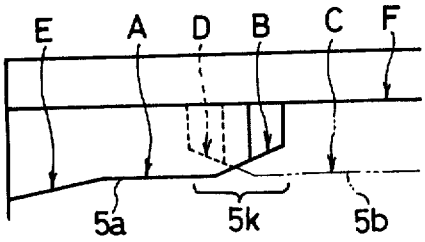
FIG. 3*b* is a side view showing the levels of the bottoms of the cam groove of the switch.
Figure 2:
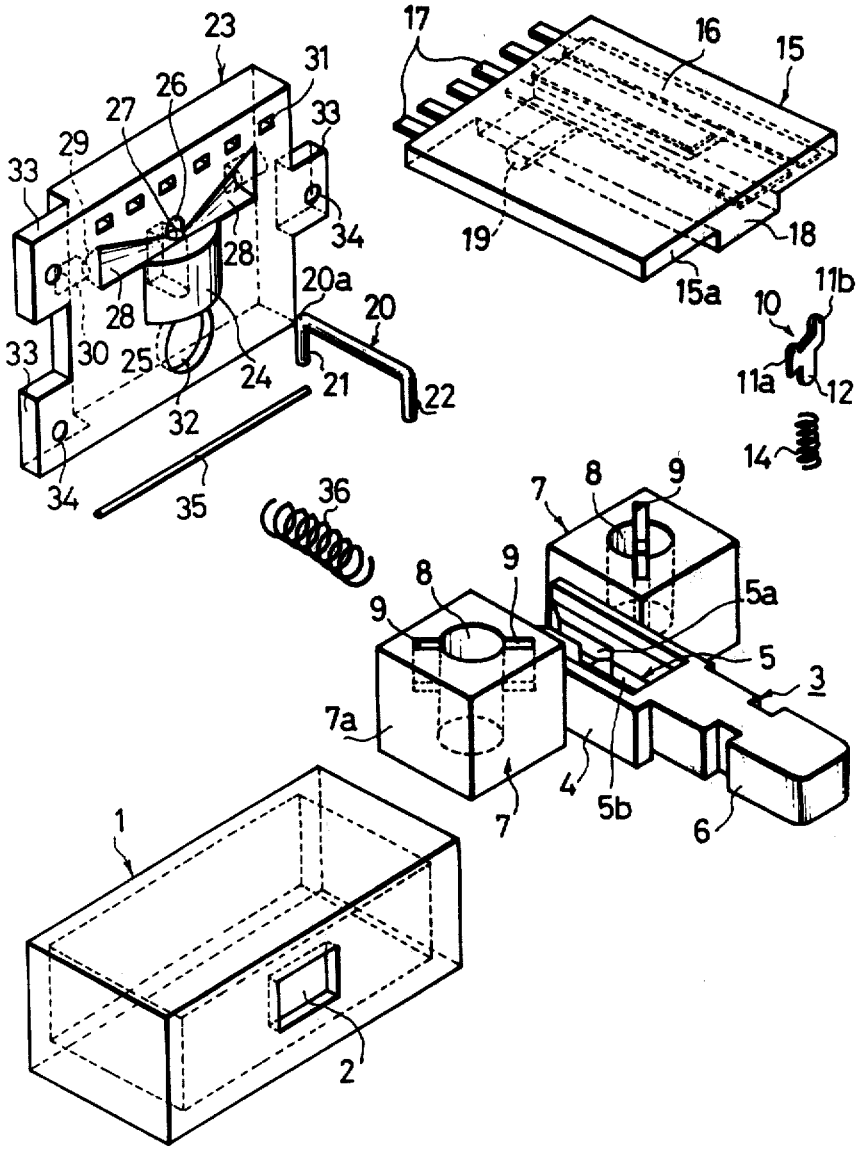
FIG. 2 is an exploded perspective view of the switch of the embodiment.
Figure 4:
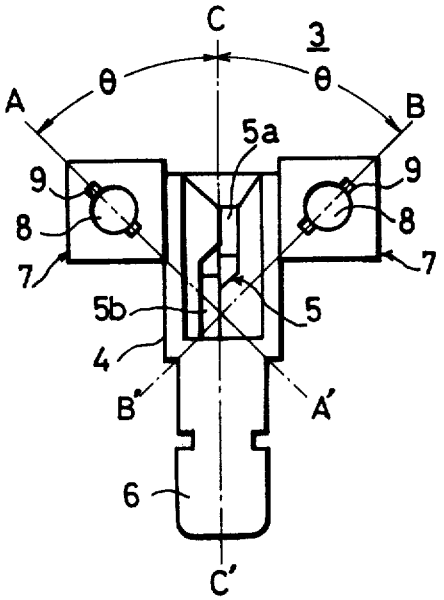
FIG. 4 is a top view of the slider of the switch.

The slider 3 is formed of a synthetic resin. The plunger 6 on which a push button (not shown) can be mounted is provided in front of a barrel 4 whose upper surface is formed with a cam groove 5 for a tactile feedback mechanism. As shown in FIGS. 3*a* and 3*b*, the cam groove 5 consists of a first slot 5*a* and a second slot 5*b* rectilinear and which are provided in parallel in alternate positions on respective sides of the center line C—C' of the barrel 4. Both the slots 5*a* and 5*b* are joined by a communicating portion 5K. The first slot 5*a* consists of slot parts A and B, while the second slot 5*b* consists of slot parts C and D. As seen from FIG. 3*b*, the bottoms of the slot parts B and D are slanted surfaces inclining upwardly from the respective part A or C. The communicating portion 5K is thus formed with a step at the boundary between the slot part B and those C and a step D and at the boundary between the slot part D and those A and B. The end walls of the slot parts B and D angle respectively toward the other slot 5*a* or 5*b*. Shown at E is a notch for facilitating engagement and disengagement of the engaging portion 22 of a tactile feedback pin 20 to be described later. As best shown in FIG. 2, holding portions 7 are formed 7 in the shape of a regular hexahedron and extend integrally from respective sides of the back part of the barrel 4. Each holding portion 7 is provided with a bottomed circular receiving hole 8 for receiving a movable contact piece 10 and a spring 14 urging the movable contact piece upwardly. A pair of cut-outs 9 are provided in each hole 8 and receive therein the side edge parts 13 (see FIG. 5) of the movable contact piece 10 as will be explained more fully below. As illustrated in FIG. 4, the lines A—A' and B—B' running through respective pairs of cut-outs 9 define angles $\theta$ with respect to the moving direction C—C' of the slider 3. In case of this embodiment, the angles are set at $\theta=45°$. The side surfaces 7*a* and the bottom surfaces (not shown) of the holding portions 7 slide in contact with both the inner side walls of the housing 1 and the inner bottom surface thereof, respectively.

Figure 5:
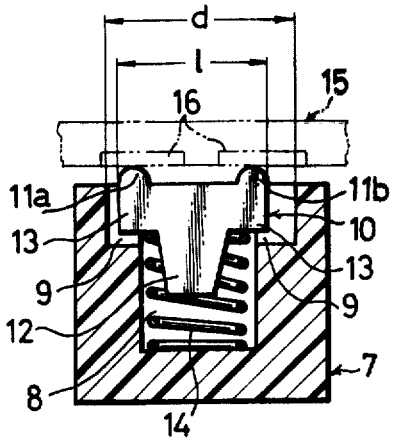
FIG. 5 is an enlarged sectional view of a movable contact-holding portion of the slider of the switch as taken along line A—A' in FIG. 4.

Each movable contact piece 10 is formed of a metal plate of high conductivity. As shown in FIG. 5, the movable contact piece 10 is provided with substantially semicircular contacts 11*a* and 11*b* extending upwardly from the upper surface of the contact piece. At the central part of its lower edge, the movable contact piece 10 is provided with a depending fastening piece 12 which is inserted and fastened to one end of the coiled spring 14 for urging the movable contact piece upwardly. The side edge parts 13 of each movable contact piece are inserted in respective cut-outs 9. The distance *d* between the outer walls of a pair of cut-outs 9 is made greater than the width l of the movable contacts piece 10.

Figure 6:
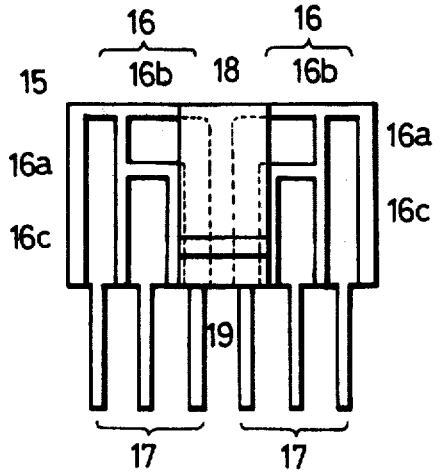
FIG. 6 is a plan view of that side of an insulating substrate in the switch on which the fixed contacts are exposed.
Figure 7:
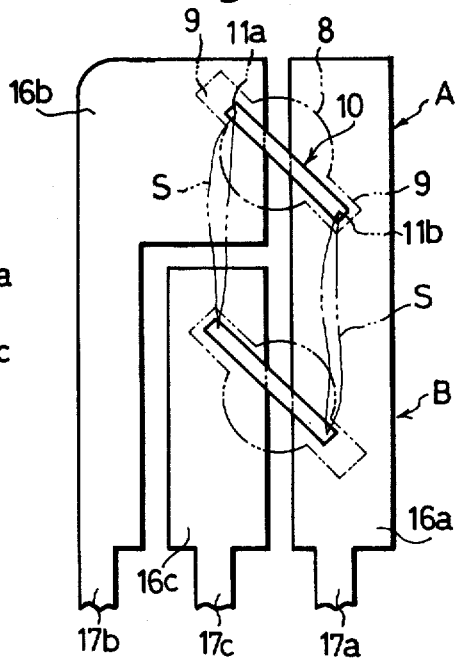
FIG. 7 is a schematic view for explaining the operation of the movable contacts of the switch.

Numeral 15 designates an insulating substrate which is made of a synthetic resin. As shown in FIG. 6, one surface of the insulating substrate 15 has two sets of fixed contacts 16 each set consisting of fixed contacts 16*a*, 16*b* and 16*c* fixedly secured by insert-molding in a manner to be symmetric with each other. The fixed contacts 16*a*, 16*b* and 16*c* are formed of metal and are integrally provided with external terminals 17 respectively. Numeral 18 indicates a stepped portion which slidably engages between the two holding portions 7 of the slider 3 so as to serve as a guide for movement of the slider. Numeral 19 indicates a protuberant strip which serves to push the rear portion of the tactile feedback pin 20 downwardly. By bending both end parts of a single elastic metal wire into a general C-shape the tactile feedback pin 20 is provided at one end with a fastening portion 21 to be fastened to a back cover 23 and at the other end with the engaging portion 22 to be engaged with the cam groove 5.

The back cover 23 is mounted on the rear of the housing 1, and is formed of a synthetic resin. As best shown in FIG. 2, a substantially semi-cylindrical bulge 24 is provided centrally on the inner surface of the back cover 23, a rectangular recess 25 is provided through the rear outer surface of the back cover 23 at a location opposite to the bulge 24, and a small recess 26 is provided centrally in the inner wall surface of the back cover 23 at a location above the bulge 24. The adjacent ends of the recess 25 and the small recess 26 are joined to form a fastening hole 27 into which the fastening portion 21 of the tactile feedback pin 20 can be inserted. In two parts of the inner wall of the back cover 23 which lie on respective sides of the small recess 26, respective elongate recesses 28 are provided. These recesses 28 are each generally in the form of a longitudinal half of a conical frustum. In the outer surface of the back cover 23 are provided two outer recesses 30 each extending inwardly to meet with the end wall of a respective recess 28. At these junctions of meeting recesses 28 and 30, fastening holes 29 are provided for receiving respective ends of a wire spring 35, as will be set forth more fully below.

Numerals 31 indicate terminal holes for receiving therethrough respective terminals 17, numeral 32 indicates a circular recess for fastening therein one end of a coiled spring 36 serving to return the slider 3, and numerals 33 indicate various lugs having mounting holes 34 for receiving respective projections (not shown) protruding from the margin of the rear surface of the housing 1. The tactile feedback pin 20 and the wire spring 35 are mounted on the back cover 23 as set forth below. The fastening portion 21 of the tactile feedback pin 20 is inserted from the small recess 26 into the fastening hole 27. Under the state in which the wire spring 35 abuts upon the inner side of the bent portion on the fastening portion 21, both the end parts of respective wire spring are inserted in the fastening holes 29. Thus, as illustrated in FIG. 1, the tactile feedback pin 20 is fastened in a manner to be pulled obliquely upwards, while the wire spring 35 is received in the recesses 28. The tactile feedback pin 20 is turnable rightwards or leftwards. However, when it is turned, a part 20*a* close to the fastening portion 21 abuts against either the right or left edge of the small recess 26 and tends to push the spring 35 out of the recesses 28. By the resilience of the wire spring 35, therefore, the tactile feedback pin 20 is subjected to a force tending to return the same to its upright position. The tactile feedback pin 20 is mounted in a manner to be turnable also in the vertical direction within an appropriate range. The wire spring 35 is formed of a single rectilinear metal wire which is strong yet resilient.

There will now be described the assemblage of the switch of the embodiment constructed of the various components described above. First, the terminals 17 are inserted through the terminal holes 31 of the back cover 23 on which the tactile feedback pin 20 and the wire spring 35 have been previously mounted as stated above. Thus, the substrate 15 is installed on the back cover 23. Secondly, the two springs 14 are inserted into the respective receiving holes 8 of the holding portions 7 of the slider 3, whereupon the movable contact pieces 10 are inserted and mounted. In that case, the side edges 13 and 13 of each movable contact piece 10 are inserted into the respective cut-outs 9. In the condition of the slider 3 in which the contacts 11*a* and 11*b* of the movable contact pieces 10 abut against the fixed contact sets 16 disposed on the insulating substrate 15, respectively, and in which the engaging portion 22 of the tactile feedback pin 20 is inserted in the cam groove 5 of the slider 3, the plunger 6 of the slider 3 is inserted through the guide hole 2 from inside the housing 1, and the insulating substrate 15 is simultaneously inserted into the housing 1. In that case, the return spring 36 is retained between the circular recess 32 of the back cover 23 and a fastening portion (not shown) provided at the rear part of the slider 3. Subsequently, the projections (not shown) disposed at the margin of the rear surface of the housing 1 are respectively inserted into the mounting holes 34 of the back cover 23, and their heads are hammered for caulking. Then, the back cover 23 is fixed to the housing 1 to complete the assemblage. Simultaneously, the substrate 15 has its edge 15*a* engaged with a recess (not shown) provided in the inner wall of the front part of the housing 1 and is fixed by the housing 1 as well as the back cover 23.

Now, the operation of the switch of the embodiment will be described. In the state in which the switch is not actuated yet, the slider 3 is urged outwardly by the spring 36, so that the holding portions 7 are stationary in abutment against the inner wall of the front part of the housing 1. Regarding the tactile feedback pin 20, its rear part near to the fastening portion 21 is pressed by the protuberant strip 19 of the insulating substrate 15 as shown in FIG. 1, and under this state, the engaging portion 22 is held in the slot part A of the cam groove 5 illustrated in FIGS. 3*a* and 3*b*. The contacts 11*a* and are 11*b* of the movable contact pieces 10 and 10 are in positions as indicated by arrow A in FIG. 7. They are in contact with the fixed contacts 16*a* and 16*b* of the fixed contact sets 16 and thus electrically connected with terminals 17*a* and 17*b*, respectively. When, under this state, the plunger 6 is pushed against the resilience of the spring 36, the movable contact pieces 10 move along with the movement of the slinder 3. The contacts 11*a* and 11*b* slide, the contacts 11*a* separate from the fixed contacts 16*b* and come into sliding contact with the fixed contacts 16*c*, and the movable contact pieces 10 arrive at positions indicated by arrow B in FIG. 7, so that the terminals 17*a* and 17*b* are disconnected and that terminals 17*a* and 17*c* are connected. The switch is thus changed-over, and the movement stops upon the abutment of the rear part of the slider 3 against the back cover 23. Meanwhile, the engaging portion 22 of the tactile feedback pin 20 rides upwardly along the slot part B from the slot part A and then enters the slot part C. At the time when the engaging portion 22 ascends the slant surface of the slot part B, goes beyond the stepped communication portion 5K and falls into the slot part C, the tactile feedback takes place to cause a click. Subsequently, when, the pressure applied to the plunger 6 is released, the slider 3 returns owing to the resilience of the spring 36. Meanwhile, the contacts 11*a* and 11*b* slide in the sense opposite to the foregoing, to disconnect the terminals 17*a* and 17*c* and to connect the terminals 17*a* and 17*b*. The engaging portion 22 of the tactile feedback pin 20 passes from the slot part C through D back to A. At that time, the tactile feedback takes place similarly to the above, whereupon the switch reverts to the original unactuated status. While the slider 3 reciprocates as described above, the tactile feedback pin 20 has its rear pressed by the protuberant strip 19 of the insulating substrate 15. Therefore, the fore end of the engaging portion 22 is always held in sliding contact with the bottom of the cam groove 5, and the tactile feedback mechanism operates reliably.

As set forth above, according to the switch of the present invention, the cam groove 5 for the tactile feedback is formed to be nearly rectilinear, so that the dimension of the cam groove at its width can be made very small. In addition, the tactile feedback is realized by composing the cam groove groove 5 of the first slot 5*a* and the second slot 5*b* and forming the steps in communication portion 5K, so that the length of the cam groove 5 may be small. Therefore, the switch can be made remarkably small in size, and even a switch in which the amount of movement of a slider is very small can be endowed with the tactile feedback mechanism of the present invention.

What is claimed is:

1. A push-button switch comprising:

a housing;

a slider having a cam groove for obtaining a tactile feedback feel and movable contact-holding portions;

a return spring for said slider;

movable contacts held in said movable contact-holding portions of said slider and normally biased upwards;

an insulating substrate fixed to said housing and formed with fixed contacts adapted to slidingly engage said movable contacts;

a plurality of terminals extending externally of said housing from said fixed contacts;

a cover member fixed to said housing and provided with first and second fastening portions;

a cam follower having one end thereof supported in a cantilever fashion by said first fastening portion of said cover member and the other end thereof held slidable on said cam groove of said slider;

a wire spring supported by said second fastening portion of said cover member and engaging said one end of said cam follower to resiliently hold said cam follower; and a protuberant strip provided on said insulating substrate and which presses a rear part of said cam follower downwards.

2. A push switch according to claim 1, wherein said cam groove in said slider consists of first and second rectilinear cam slots whose bottoms have slant surfaces and which are parallel to each other, said first and second cam slots adjoining alternately and having said slant surfaces joined with each other, terminal parts of said first and second cam slots being formed with walls which terminate at a center line between both said slots.

3. A push switch according to claim 1, wherein said slider has a plunger, the pair of movable contact-holding portions being disposed on respective sides of said plunger, and said insulating substrate is provided in its central part with a stepped portion for guide, which is located between said pair of movable contact-holding portions.

4. A push switch according to claim 3, wherein each of said pair of movable contact-holding portions is formed into a substantially cubic shape, and is formed in its central part with a hole for receiving the movable contacts.

5. A push switch according to claim 4, wherein said movable contacts and a coiled spring for biasing them upwards are received in said receiving hole.

* * * * *